US007507366B2

(12) United States Patent
Mizuno et al.

(10) Patent No.: US 7,507,366 B2
(45) Date of Patent: Mar. 24, 2009

(54) CONTAINER, STORING BATH AND A METHOD OF PRODUCING THE CONTAINER

(75) Inventors: Hitoshi Mizuno, Toyota (JP); Tsuyoshi Abe, Tokyo (JP)

(73) Assignee: Hoei Shokai Co., Ltd., Aichi (JP)

( * ) Notice: Subject to any disclaimer, the term of this patent is extended or adjusted under 35 U.S.C. 154(b) by 442 days.

(21) Appl. No.: 10/565,154

(22) PCT Filed: Feb. 21, 2005 (Under 37 CFR 1.47)

(86) PCT No.: PCT/JP2005/002718

§ 371 (c)(1), (2), (4) Date: Jan. 19, 2006

(87) PCT Pub. No.: WO2005/080026

PCT Pub. Date: Sep. 1, 2005

(65) Prior Publication Data

US 2007/0108675 A1 May 17, 2007

(30) Foreign Application Priority Data

Feb. 20, 2004 (JP) ..... 2004-045537

(51) Int. Cl.
*C21C 5/44* (2006.01)
*C21B 7/04* (2006.01)

(52) U.S. Cl. ..... 266/239; 266/286; 266/275

(58) Field of Classification Search ..... 266/239, 266/275, 286, 45; 222/595

See application file for complete search history.

(56) References Cited

U.S. PATENT DOCUMENTS

| | | | | |
|---|---|---|---|---|
| 4,422,625 | A | 12/1983 | Thurn | |
| 6,196,294 | B1 | 3/2001 | Ohnsmann et al. | |
| 7,204,954 | B2 * | 4/2007 | Mizuno et al. | 266/239 |
| 2007/0013114 | A1 * | 1/2007 | Abe et al. | 266/236 |

FOREIGN PATENT DOCUMENTS

| | | | |
|---|---|---|---|
| CN | 2325741 | Y | 6/1999 |
| EP | 1 410 861 | A1 | 4/2004 |
| GB | 846302 | | 8/1960 |
| JP | 06-031435 | A | 2/1994 |
| JP | 11-320080 | | 11/1999 |
| JP | 2002-254159 | | 9/2002 |
| JP | 2003-083682 | A | 3/2003 |
| JP | 2003-266173 | | 9/2003 |
| JP | 2004-074183 | A | 3/2004 |
| WO | WO-92/20479 | | 11/1992 |
| WO | WO-03/101646 | A1 | 12/2003 |

OTHER PUBLICATIONS

UK IPO Office Action, App. No. GB0521503.3, Aug. 2, 2007 (2 pages).

(Continued)

*Primary Examiner*—Scott Kastler
(74) *Attorney, Agent, or Firm*—Rader, Fishman & Grauer, PLLC

(57) ABSTRACT

A container (1) and method of manufacturing, capable of preventing unexpected rise of pressure inside the container (1) caused by problems pertaining to the lining. The container has a structure such that the insulating wall (8) is laid on the inner side of the frame body (6), and the refractory storing bath (9) is detachably inserted through the opening (5) of the frame body into the container.

8 Claims, 7 Drawing Sheets

OTHER PUBLICATIONS

CN PO Notification of the First Office Action, App. No. 200580000285.8, Aug. 3, 2007 (6 pages).
UK IPO Examination Report, App. No. GB0521503.3, Feb. 15, 2008 (2 pages).
UK IPO Combined Search and Examination Report, App. No. GB0802019.0, Feb. 15, 2008 (3 pages).

* cited by examiner

CONTAINER, STORING BATH AND A METHOD OF PRODUCING THE CONTAINER

FIELD OF THE INVENTION

This invention is related, for example, to a container suitable for transporting molten aluminum, a bath used for the container and a method of producing the container.

BACKGROUND OF THE INVENTION

In a factory where aluminum is molded using many die-casting machines, an aluminum material is often supplied not only from within the factory but also from outside of the factory. In such a case, a container storing aluminum in a melt is carried from a factory on the material supply side to a factory on the molding side to supply to each of the die-casting machines the material kept in the melt. (For example, see the patent literature 1)

A container of this kind is produced, for example, by coating a plurality of layers such as a heat-insulating layer or a refractory layer onto an inner wall of the frame made of metal.

[Patent Literature]JP-UM-A-3-31063 (FIG. 1)

DISCLOSURE OF THE INVENTION

Problems to be Solved

However, as described in the patent literature 1, in a hermetically closed-type container that supplies the molten metal to an outside using a pressure difference, a fluid component contained in the lining and a component of the lining crystallized as an aqueous solution evaporated by the heat of the molten metal inside container, causing the pressure inside the container to rise to an unexpected level. In such a case, for example, the molten metal may gushes out unexpectedly from a pipe provided to become a flow path for providing the molten metal to the outside. In order to prevent such case, it is necessary to dry the lining thoroughly after the step of molding thereof, however, being comprised of a plurality of layers, the drying step is very troublesome. For this reason, there is a problem that the production of the container requires very long time, thus the productivity thereof is very low.

In addition, in a hermetically closed container of this type, it is necessary to avoid cracking of the lining as much as possible in order to prevent the loss of pressure and gas being mixed into the container. For example, when the cracking reaches from a space inside the container to the flow path, a gas for applying pressure directly flows through the cracking portion into the flow path, and the supply of the molten metal becomes unstable. Furthermore, there is also a problem in that the molten metal in a state of containing the gas therein is blown out of the pipe and molten metal with high temperature is splattered in a surrounding area. However, such cracking in the lining is inevitably caused by mechanical vibration given to the container when being transported, a thermal expansion of the molten metal etc. In such case, replacing the lining (relining) is normally performed. However, there is a problem in that such relining being very inefficient since a plurality of layers must be coated and dried.

The present invention is made to overcome such problem, and the object of this invention is to provide a container that is capable of preventing unexpected rise of the pressure inside the container caused by the problem pertaining to the lining.

In addition, object of the present invention is to provide a container in which re-lining process can be carried out effectively or the method of producing thereof.

Means for Solving the Problem

To solve such problem, the prime object of the present invention is to provide a container capable of being hermetically closed and storing a molten metal and supplying the molten metal to an outside using a pressure difference comprised of a frame body having an opening at an upper portion thereof, an heat-insulating wall laid onto an inner wall of the frame body, a refractory storing bath, detachably inserted to an inner side of the heat-insulating wall from the opening of the frame body to be integrally provided with the frame body, a lid that covers the opening of the frame body, an introductory (or induction)portion that introduces (or induces) a gas for applying pressure into the storing bath covered with the lid and a supplying portion that supplies the molten metal stored inside the storing bath to an outside.

Since a container of the present invention has a structure such that the heat-insulating wall is being laid onto the inner side of the frame body and the refractory storing bath is detachably inserted from the opening of the frame body to be integrally provided with the container, a member that comprises the container can be made into components. Thus manufacturing of the container can be substantially made into "assembling" of such components. In other words, a process such as casting of lining that could be regarded as a step of producing a masterpiece can be removed. Especially, process of casting a lining requires considerable long time and also an individual product tend to become different from each other. The present invention can provide a container of high quality efficiently. For this reason, maintenance of a component, for example, a lining (that corresponds to a heat-insulating wall or a refractory storing bath) can be performed individually, therefore, problem that the inner pressure rising unexpectedly caused by the defects pertaining to lining can be prevented. In addition, relining process can be carried out as merely replacing the component. Therefore, relining can be performed efficiently. Such effect is just an example, and merit that of making the lining into a component will have an effect to other fields.

Here, in the present invention, it is preferable that an insulating member in granule or powder form is provided between the heat-insulating wall and the refractory storing bath.

The insulating member of either a granule form or a powder form eases the mechanical impacts inflicted to the refractory storing bath, thus the cracking can be prevented from occurring. In addition, use of this member facilitates replacement operation of the refractory storing bath. Therefore, relining can be performed easily and efficiently.

It is preferable for the present invention that a refractory and heat-insulating member containing a binder having a fusing point higher than that of the molten metal is inserted between the heat-insulating wall and the refractory storing bath. For example, when the molten metal is a molten aluminum and melts at 720 degrees Celsius, a binder that melts at 800 degrees Celsius can be used. In this case, as a refractory and heat-insulating member, for example, a material containing alumina for 35 percent by weight and silica for 25 percent by weight can be used.

A solid refractory insulating member as explained above can be formed by inserting a powder form refractory and insulating member between the heat-insulating wall and the refractory storing bath when assembling, then having it melt by heating thereof at 800 degrees Celsius then having it solidify later. Using the refractory insulating member in a solid form prevents sliding in a position of the storing bath when transporting, and the like, the container. In addition, since nothing in fluid form is used when assembling the container, drying step is not necessary to be included. Furthermore, the breaking up of the storing bath at the time of replacement thereof may be facilitated by using a member more fragile than the storing bath as the refractory insulating member in solid form.

It is preferable that the storing bath has a flow path for flowing the molten metal between the storing bath and an outside located inside the storing bath to be integrally provided therewith. In other words, it is preferable that the storing bath has a flow path that consists a part of the supplying portion in the inside thereof. In such a case, the supplying portion is preferably comprised of the flow path and a pipe connected to the flow path.

Another embodiment of the present invention regarding a method of producing a container capable of being hermetically closed storing a molten metal and supplying the molten metal to an outside using a pressure difference that comprises, laying an heat-insulating wall on an inner wall of the frame body having an opening at an upper portion thereof, inserting a refractory storing bath from the opening of the container to an inner side of the heat-insulating wall and covering the opening of the frame body with the lid.

According to the present invention, since the storing bath is detachably inserted from the opening of the frame body to the inner side of the heat-insulating wall, the production of the container and the lining can be processed very easily. In addition, a dried heat-insulating wall and a refractory storing bath, both being made into components, can be used, drying step becomes unnecessary thus time consumed for manufacturing the container can be very short.

It is preferable that the method further comprises the steps of inserting between the heat-insulating wall and the refractory storing bath, (1) a refractory and heat-insulating member in granule form, (2) refractory and heat-insulating member in powder form or (3) a refractory and heat-insulating member containing a binder having a fusing point higher than that of the molten metal and causing the refractory insulating member to melt and solidifies.

Another embodiment of the present invention is comprised of a storing bath for storing a molten metal used for a container capable of storing a molten metal and supplying the molten metal to an outside using a pressure difference, having approximately a tubular shape, and a protruding portion extending to a vertical direction formed on an inner side of the container and the flow path for the molten metal is provided inside the protruding portion.

Another embodiment of the present invention is comprised of a storing bath for storing a molten metal used for a container capable of storing a molten metal and supplying the molten metal to an outside using a pressure difference, having approximately a cylindrical shape, and a protruding portion extending to a vertical direction formed on an inner side of the container, the flow path for the molten metal has at least a pre-cast segment provided in the protruding portion, and a pipe made of ceramics surrounding at least a part of the flow path. The pipe made of ceramics may be fixed integrally to the pre-cast segment or may be provided as being exchangeable. In the latter case, when the pipe is fixed using a cushion member having strength smaller than the pre-cast segment and the pipe made of ceramics, the ceramics pipe can be replaced like a cartridge type. In addition, the ceramics pipe has a concave and convex portion on the outer surface in order to prevent the sliding of the pipe and the storing bath. The concave and convex portion may be something like a brim or may be a groove on either side. With such concave and convex portion, the pipe can be inhibited from sliding or falling apart.

Furthermore, it is preferable to have an overhang on an upper portion of the protruding portion on an inner side of the storing bath. The overhang portion provides sufficient size of plane for connecting the storing bath to the container body and then to the lid.

The storing bath of the present invention is for storing a molten metal used for a container capable of storing a molten metal and supplying the molten metal to an outside using a pressure difference and comprised of engaging members fixed to an upper face, outer surface or an inner surface thereof enabling the connection with an outside.

Another embodiment of the present invention is a container capable of storing a molten metal comprised of a frame, a storing bath (pre-cast segment) having a flow path for causing the molten metal flow from the inside to the outside of the container and a pipe disposed to surround at least a part of the flow path.

Yet another aspect of the present invention is a container capable of storing a molten metal comprises a frame and a storing bath, having a flow path for flowing the molten metal therein; the flow path being provided an inside of the frame and at least a part thereof is surrounded by a member restricting a flow of a gas. A molded product made of ceramics material and the like can be cited as a storing bath of this type. Here, ceramics means a non-metal inorganic material produced by taking processing steps such as sintering and molding, containing at least one of, for example, $Al_2O_3$, $SiO_2$, SiC, SiN, $Si_3N_4$, TiN, $TiO_2$, carbon and graphite as a primary component. In addition, a molded product of so-called indeterminate form refractory material or sintered products is included in the ceramics defined as above. As a storing bath, material having a big strength, aluminum proof (with regard to permeation and reactivity) and spalling proof are preferable.

In addition, as a restricting member of this kind, materials such as metals (including an alloy) and ceramics can be cited. Here, ceramics means a non-metal inorganic material produced by taking processing steps such as sintering and molding, containing at least one of, for example, $Al_2O_3$, $SiO_2$, SiC, SiN, $Si_3N_4$, TiN, $TiO_2$, carbon and graphite as a primary component. Further, a molded product of so-called indeterminate form refractory material or sintered products are included in the ceramics defined as for the storing bath.

Furthermore, the restricting member is preferably constituted of a layer thermodynamically uniform from a macroscopic viewpoint. This is because in the case of a mixture being made of a plurality of materials different in the physical properties, in other words, in the case of a mixture being made of a layer thermodynamically non-uniform from a macroscopic viewpoint, cracking and the like are likely to occur caused by periodically applied thermal load, difference in the thermal expansion coefficients and so on, and thereby a gas is allowed to flow in. According to the present invention, because of the pipe made of restricting member, gas can be inhibited from entering into the flow path, even when the flow path of the storing bath cracks.

In the present invention, as the pipe, a ceramics pipe or a metal pipe inside of which is lined with a refractory material is preferably used. As the metal, for instance, SGP, STPT (carbon steel tube for high temperature pipe) or STPG (carbon steel tube for pressure pipe) can be used.

As the refractory member, for instance, refractory members (including refractory caster, heat-insulating material, and heat-insulating caster) for molten aluminum, molten magnesium and so on can be used. These refractory members may be mixed with ceramics, carbon or graphite. Thereby, the non-wettability of the molten metal to the pipe can be improved and the strength thereof can also be improved. Furthermore, the maintenance also becomes easier. More specifically, as the refractory members, trade name TMU 85AEFN ($Al_2O_3$: 82 percent, $SiO_2$: 13 percent) and SC SAE85 ($Al_2O_3$: 8 percent, SiC: 83 percent, $SiO_2$: 7 percent) both manufactured by NIPPON TOKUSHUROZAI KK can be cited. However, the present invention is not restricted to such materials but ceramics as described above can be used.

In the present invention, since the flow path is provided inside the storing bath, the thermal conduction from the molten metal storing portion to the flow path is high. Accordingly, since the heat retaining property of the molten metal that flows the flow path can be improved and the fluidity can be maintained, the possibility that the flow path being clogged becomes extremely low. In addition, since the flow path is surrounded with a member that restricts the flow of a gas such as a metallic pipe or a ceramics pipe, a gas for applying pressure does not leak to the flow path. Accordingly, the molten metal can be stably supplied. Furthermore, the ceramics layer is effective for the thermal insulation of the flow path since the ceramics layer has high thermal conductivity. Here, ceramics means a material containing at least one of, for example, $Al_2O_3$, $SiO_2$, SiC, SiN, $Si_3N_4$, TiN, $TiO_2$, carbon and graphite as a primary component. In addition, a molded product of so-called indeterminate form refractory material or sintered products is included in the ceramics defined as above. For example, as a storing bath, trade name LEOCAST-15M, trade name LEOCAST-32T, trade name AC-NL-1 of TYK corp., can be cited. For example, as the ceramic pipe, trade name SCN (SiC: 74.8 percent, $Si_3N_4$: 23.54 percent) manufactured by TYK Corp., trade name KN-101 (mainly made of $Si_3N_4$) manufactured by Kubota Corp., trade name SN 220 (mainly made of $Si_3N_4$) manufactured by Kyocera Corporation, and trade name Sialon HCN 10 (mainly made of $Si_3N_4$) manufactured by Hitachi Metals Ltd. can be cited. These are molded by means of, for instance, a CIP (Cold Isostatic Press) method. Pressure applied for such case is preferably 10000 kgf/cm$^2$ or more. In general, the ceramics pipe has high degree of mechanical strength but cracking is likely to occur owing to the thermal load. However, in the present invention, since the ceramic pipe is buried in the storing bath, the outside of the pipe is not directly exposed to a high temperature during preheating of the container, therefore, the lifetime thereof is very long. Furthermore, even when the pipe cracks caused by a vibration at a time of transportation, the supply of the molten metal can be continued as far as the flow path is maintained. Accordingly, a situation where the molten metal becomes suddenly incapable of being supplied at the user side and the container has to be carried back can be avoided.

Here, from the viewpoint of the heat-retaining property of the flow path, the flow path preferably is disposed inside the lining from a position close to a bottom portion inside the container to a top surface side of the container. As an example of arrangement of the flow path, a storing bath having a protruding portion being formed such that to extend to an upper direction and to a lower direction and to protrude to an inner wall side of the container, and a flow path being formed inside the protruding portion along with the direction that the protruding portion extends. A container for supplying molten metal can be assembled by disposing such storing bath inside the frame and refractory and heat-insulating member between the storing bath and the frame.

Furthermore, when the flow path is structured so that being surrounded by a pipe buried in the lining, and when the pipe is made into a cartridge, the flow path becomes exchangeable once it is clogged. The pipe may be disposed so as to surround not the whole of the flow path but a part thereof. When the storing bath itself is made of a fine ceramics, basically there is no need to provide a pipe, however, production cost would rise.

When a structure where an inner surface of the pipe is covered with a member having refractory property, the durability of the pipe can be improved and the gas for applying pressure can be prevented from leaking into the flow path for a long time period. Furthermore, the protruding portion preferably has a tapered shape in the neighborhood of a lower opening of the pipe so that the inside of the container may become wider. Thereby, during the maintenance of the container, the accessibility from the inside of the container toward the lower portion of the pipe can be improved. This configuration, together with a detachable structure of the lid, improves the maintenance properties of the container and the reliability of the container.

Furthermore, structure of a storing bath having a flow path therein is explained here, however, the storing bath is not limited to this form. For example, a storing bath with a simple cylindrical shape may be adopted and the flow path of the molten metal can be structured solely with a pipe made of ceramics.

The container body of the present invention basically adopts prefabricated frame structure of molded products. For example, the container body of the present invention is structured such that disposing a refractory and heat-insulating material between a pre-cast segment of the storing bath that is molded before the assembly, and a frame made of metal. The frame and the storing bath were prepared beforehand. A refractory material (for example, a molded product such as U-brid™, microtherm™) is laid on the inner side of the frame, and a dried powder of indeterminate form refractory material is laid on the bottom thereof and the storing bath is placed thereon. Then the container body of the present invention is structured as filling the gap between the insulating material and the storing bath with a dried powder of indeterminate form refractory material. For a container of the present invention, it is preferable to mix a thermosetting type binder material with the dried powder form of indeterminate form refractory material that surrounds the bottom and outside of the storing bath. With this configuration, the binder solidifies by the heat from pre-heating of the container when being used for the first time. As a result, the strength of the indeterminate form refractory material increases which leads to an improved "ability to hold" of the storing bath. In addition, the storing bath will be held firmly even when being tilted at the time of maintenance, turned upside down, applied with vibration at the time of transportation thus breaking down caused by unexpected stress and sliding from its original position can be prevented.

BEST MODE FOR CARRYING OUT THE INVENTION

Hereinafter, embodiments of the present invention will be described with reference to the drawings.

FIG. 1 is an exploded view of the container in connection with an embodiment of the present invention, FIG. 2 is a sectional view of the container in assembly, FIG. 3 is a front view thereof, FIG. 4 is a plane view without a lid and FIG. 5 is a plane view with a lid.

A container 1 is comprised of a container body 2, a lid 3 and a first pipe 4 and a second pipe 5.

The container body 2 has a frame body 6 made of metal bottomed and approximately cylindrically shaped having an opening at a top thereof, a heat-insulating wall 8 laid on an inner wall 7 of the frame body 6 having an elasticity, and a refractory storing bath 9 detachably disposed on the innerwall 7 side of the heat-insulating wall from the opening of the frame body 6.

A refractory and heat-insulating member 10 in granule form or powder form is inserted in a space between the heat-insulating wall 8 and the storing bath 9. As such refractory and heat-insulating member 10, for example, a dried powder of the heat-insulating material containing $S_1O_2$, $Al_2O_3$ and the like can be used. In addition, as another embodiment, for example, 35 percent by weight of Alumina, 25 percent by weight of Silica and a solid form of refractory and heat-insulating member containing a binder having a fusing point of 800 degrees Celsius may be used as the refractory and heat-insulating member 10. In this case, the refractory and heat-insulating member 10 in powder form is fed into a space between the heat-insulating wall 8 and the storing bath 9 then the binder is heated to a temperature above 800 degrees Celsius, and let it solidify later. Furthermore, using a member more fragile than that of the storing bath 9 as a refractory and heat-insulating member 10 in solid form enables to break up the storing bath 9 easily at a time of replacement of the storing bath 9. Therefore, the replacement operation of the storing bath 9 becomes easy.

A flange 11 is provided at an outer peripheral of the opening of the frame body 6. A pair of a channel member 12 is attached to the bottom, outside of the frame body 6. A fork (not shown) of a fork lift truck for transporting the container 1 is disposed so that it is capable of being inserted and being pulled out.

A molded product such as a U-brid™, microtherm™ and the like can be used as a heat-insulating wall 8. The heat-insulating wall 8 is, for example, structured from a plurality of pieces of fragments being laid on the inner wall 7 of the frame body 6 with an adhesive agent.

A pair of protruding portion 13 is disposed integrally with the storing bath 9 in a vertical direction on the inner circumference of the inner wall of the storing bath 9. A flow path 14 for having a molten metal flow between inside and outside container is provided inside the protruding portion 13 along with the vertical direction. The flow path 14 penetrates from a position close to the bottom of the inside of the storing bath 9 to upper surface.

Here, the protruding portion 13 has a overhang structure close to an upper surface portion of the storing bath forming a structure 13*a*. With this structure, the air-tightness between the upper surface of the protruding portion 13 and the lid 3 is secured, thus the molten metal is prohibited from leaking out therefrom.

A first pipe 4 made of, for example, ceramics is integrally fixed to the flow path 14. With this configuration, intrusion of a gas into the flow path 14 at a time of pressurization of the storing portion can be prevented. The first pipe 4 is disposed so that it protrudes slightly from the upper surface of the storing bath 9. In order to protect the protruding parts of the first pipe 4, a protective layer 17 may be protruded to integrally surround the first pipe 4. This protective layer 17 may be omitted. In addition, the shifting in position of the first pipe 4 can be prevented by providing a plurality of grooves in a horizontal direction with 3 mm in depth and 50 mm in length on the surface of the first pipe 4. Meanwhile, the first pipe inserted may be provided replaceable.

In addition, the flow path 14 is extended to a the main body (on the side) of the storing bath 9 beyond the protruding portion 13 and an opening 15 that opens up to the inner side of the container connected to the flow path 14 is provided at around the bottom of the container. However, at this part, the passage that extends as far as the to the storing bath 9 does not exist and in consequence a stage portion 16 protruding from the main body of the storing bath 9 is provided. In order to maintain the space between the lower end surface of the first pipe 4 and the bottom face of the storing bath 9, (corresponds to, for example a height of the opening 15), the stage portion 16 constitutes a holding member holding the lower end surface of the pipe 4. With this configuration, the first pipe 4 can be prevented from being fallen off.

A corner portion 18 where the bottom face and the inner wall crosses is set to in a range of approximately R50 mm to R80 mm. Thereby the cracking of the storing bath 9 can be prevented. In addition, four holds 19 for attaching anchor bolts as engaging member are disposed at predetermined positions on the upper surface of the storing bath 9. With this configuration, the lifting and lowering movement of the storing bath 9 through anchor bolts using a crane becomes possible, leading to improvement of the workability in the manufacturing process. Further, replacing the storing bath 9 is easy using such engaging member.

A lid 3 is comprised of a large lid 20 and a hatch (a small lid) 21. A flange 22 is disposed at an outer periphery of the large lid 20 and the container body 2 and the lid 3 is fixed together as securing the flange 22 and a flange 11 provided at a periphery of the opening of the frame body 6 with a bolt (not shown) and the container 1 becomes hermetically closed.

At almost the center of the aforementioned large lid 20, an opening 23 is provided, and a hatch (little lid) 21 with a handle (not shown) attached thereto is disposed at the opening 23. The hatch 21 is provided at a position slightly higher than the upper face of the large lid 20. A portion on the outer periphery of the hatch 21 is attached to the large lid 20 through a hinge 25. This allows the hatch 21 to freely open and close against the opening 23 of the large lid 20. In addition, bolts with handles 26 for fixing the hatch 21 to the large lid 20 are attached at two points of the outer periphery of the hatch 21 in a position opposite to the position to which the hinge 21 is attached. The hatch 21 is fixed to the large lid 20 by closing the opening 23 in the large lid 20 with the hatch 21 and rotating the bolts 26 with handle. On the other hand, by inversely rotating the bolt 26 with the handle to release the fixation, the hatch 21 can be opened from the opening 23 of the large lid 20. Then, with the hatch 21 being opened, maintenance of the inside of the container 1 and insertion of a gas burner at the time of preheating can be performed through the opening 23.

Further, a passage 27 for internal pressure control for reducing and applying pressure in the container 1 is provided at a center or a position slightly off from the center of the hatch 21. To the passage 27, a pipe for applying and reducing pressure (not shown) is to be connected. The pipe extends upward from the passage 27, bends at a predetermined height, and extends in the horizontal direction. The surface of a portion of the pipe that is to be inserted into the passage 27 is threaded, and on the other hand, the passage 27 is also threaded. This firmly screws the pipe to the passage 27. FIG. 5 shows a state where the passage 27 is closed by the cap 28. The other passage 29, (there are many in practice), is also closed by the cap 30, however, for example, an electrode for detecting, for example, a liquid surface is to be inserted into the passage 29. In addition, the large lid 20 and the hatch 21 is structured as such that a lining (layers of a heat-insulating layer and a refractory layer) is disposed on an inner side of the frame made of metal. Here, the cap 28 and the cap 30 are socket (a hiding member) that constitutes a coupler of a plug and a socket.

An opening 31 is provided at a position corresponding to the flow path 14 of the large lid 20. The outer periphery thereof is protruded and a flange 32 is provided at the top of the protruded portion. The flange 32 is fixed with the flange 33 disposed at the second pipe 5 and the second pipe 5 is fixed to the container 1.

According to container 1 of the present invention, when inside the container 1 is applied with pressure through the passage 27, the molten aluminum stored in the storing bath 9 is supplied to an outside through the flow path 14 and the pipe 5. In addition, when inside the pressure inside the container 1 is reduced through the passage 27, the molten aluminum is introduced into the container 1 from an outside through the flow path 14 and the pipe 5 and the molten aluminum is stored in the storage tank 9.

Since the container 1 of the present invention has a structure such that the heat-insulating wall 8 is being laid onto the inner side of the container body 6 and the refractory storing bath 9 is detachably inserted from the opening 5 of the frame body 6 to be integrally provided with the container, the time consumed for drying can be shortened and the lining inside the container 1 can be prevented from containing fluid. Especially, a heat-insulating wall 8 and a refractory storing bath 9 are both being made into dried components, drying step becomes unnecessary thus time consumed for manufacturing the container can be very short.

Next, description will be made on the method of manufacturing the container 1 with referenced to FIG. 1.

(1) Laying the heat-insulating wall 8 on an inner wall 7 of the frame body 6. The heat-insulating wall 8 is, for example, formed as a plurality of pieces of fragments being laid onto the inner wall 7 of the frame body 6 with an adhesive agent.

(2) Furthermore, a block of, for example, 50 mm×50 mm in area and 25 mm of thickness may be laid on the four places on the inner bottom face of the frame body 6 laid with the heat-insulating wall 8. This block is for keeping the horizontal level of the storing bath 9 to be inserted by holding the outer bottom face thereof.

(3) Spreading a heat-insulating member 10 either in granule form or powder form (or dried powder of the heat-insulating member) to the inner bottom face of the frame body 6 laid with the heat-insulating wall 8.

(4) Inserting the storing bath 9 to the inner wall side of the heat-insulating wall 8 from the opening of the frame body 6. At this time, a plate for determining the position is disposed at a hold 19 for attaching an anchor bolt of the storing bath 9 and a protective layer 17, and, for example, the position is fixed by having the storing bath 9 match with the bolt hole provided on the flange of the frame body 6. In other words, the position adjustment of the frame body 6 and the storing bath 9 is performed based on the above-mentioned bolt-hole.

(5) A refractory and heat-insulating member 10 in either granule form or powder form is poured into the space formed between the heat-insulating wall 8 and the storing bath 9 and the space is filled with the refractory and heat-insulating member 10 by, for example, having it vibrate. Furthermore, the layer of the refractory and heat-insulating member 10 can be solidified caused by the heat obtained when using the container 1 (heat from the molten aluminum or heat of gas burner at a time of pre-heating) by mixing a binder in the refractory and heat-insulating member 10. Here, 10 per cent by weight of a thermosetting type binder is mixed herewith.

(6) A flange is fixed with the bolt as the lid 3 is placed on the opening and having packing in between. It is preferable that the lid 3 to be dried beforehand.

(7) The first pipe 4 is inserted into the flow path 14 of the storing bath 9 through the opening 31 of the large lid 20. In addition, the first pipe 4 may be fixed integrally with the storing bath 9 as a molded product of a pre-cast segment.

(8) The second pipe 5 is fixed with the flange 33 disposed at the second pipe 5 and the second pipe 5 is fixed to the container 1.

As explained above, according to the method of manufacturing the container 1 of this embodiment, since the storing bath 9 is detachably inserted from the opening of the frame body 6 to the inner side of the insulating wall, the production of the container 1 can be done very easily. In addition, a dried heat-insulating wall 8 and a refractory storing bath 9 and the like can be used when assembling the container, drying step becomes unnecessary thus time consumed for manufacturing the container can be very short.

Next, another embodiment of the method of manufacturing the container 1 will be described.

(1) Laying the heat-insulating wall 8 on an inner wall 7 of the frame body 6.

(2) As shown in FIG. 6, a position locating tool having a diameter larger than that of the upper opening and having, for example, a semi circle in shape, is to be placed on top of the upper opening. With regard to two out of the four holes 19 for attaching anchor bolts, anchor bolt 43 is fixed through the hole 42 provided on the position-locating tool for locating position. For the remaining two holes 19 for attaching the anchor bolt, the anchor bolt 43 can be attached directly.

(3) The storage tank 9 is hanged up as hooks 44 of the crane catches the anchor bolts 43 attached at four positions and the storage tank 9 is being held into the frame body 6 laid with the insulating wall 8.

(4) As shown in FIG. 7, for example, four holes 45 (refer to FIG. 6) provided on the position locating tool for locating positions and the bolt hole 46 provided on the outer periphery of the frame body 6 and the flange 11 (i.e. holes provided for fixing the large lid 20 and the flange 22 with the bolt) are adjusted to match with each other in position, and the hole 45 (refer to FIG. 6) and the hole 46 are fixed with the bolt 47. In this way, the position of the storing bath 9 is determined.

(5) A refractory and heat-insulating member 10 in powder form containing a binder is poured into a space formed between the heat-insulating wall 8 and the storing bath 9 and the refractory and heat-insulating member 10 is temporarily melted by heating thereof at approximately 800 degrees Celsius and have it solidified. This step can be performed without the position-locating tool for locating position or with the position-locating tool being attached.

(6) A flange 6 is fixed with the bolt as the lid 3 is placed on the opening and having packing in between. It is preferable that the lid 3 to be dried beforehand.

(7) The first pipe 4 is inserted into the flow path 14 of the storing bath 9 through the opening 31 of the large lid 20. In addition, the first pipe 4 may be fixed integrally with the storing bath 9 as a molded product of a pre-cast segment.

(8) The second pipe 5 is fixed with the flange 33 disposed at the second pipe 5 and the second pipe 5 is fixed to the container 1.

According to the present invention, the productivity of manufacturing container can be improved. Although raw materials of a container of this type are inexpensive, it has many manufacturing steps such as molding, drying and the like, therefore, the cost of manufacturing can be reduced according to the present invention.

Furthermore, in the present invention, structure of a storing bath having a flow path therein is explained, however, the storing bath is not limited to this form. For example, a storing bath with a simple cylindrical shape may be adopted and the flow path of the molten metal can be structured with solely a pipe made of ceramics.

EXPLANATION OF CODES

Figure 1:
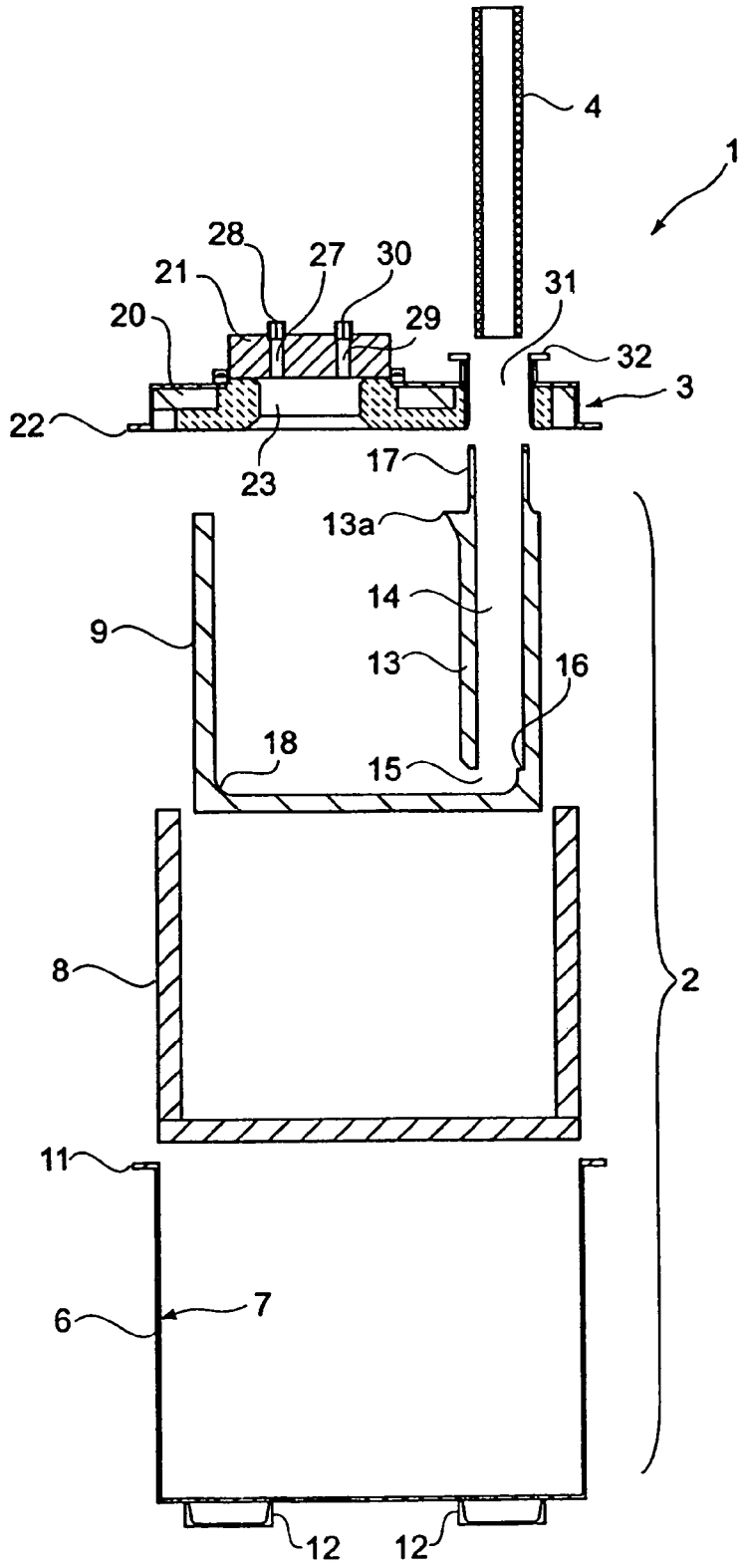
FIG. 1 is an exploded view of the container according to an embodiment of the present invention.
Figure 2:
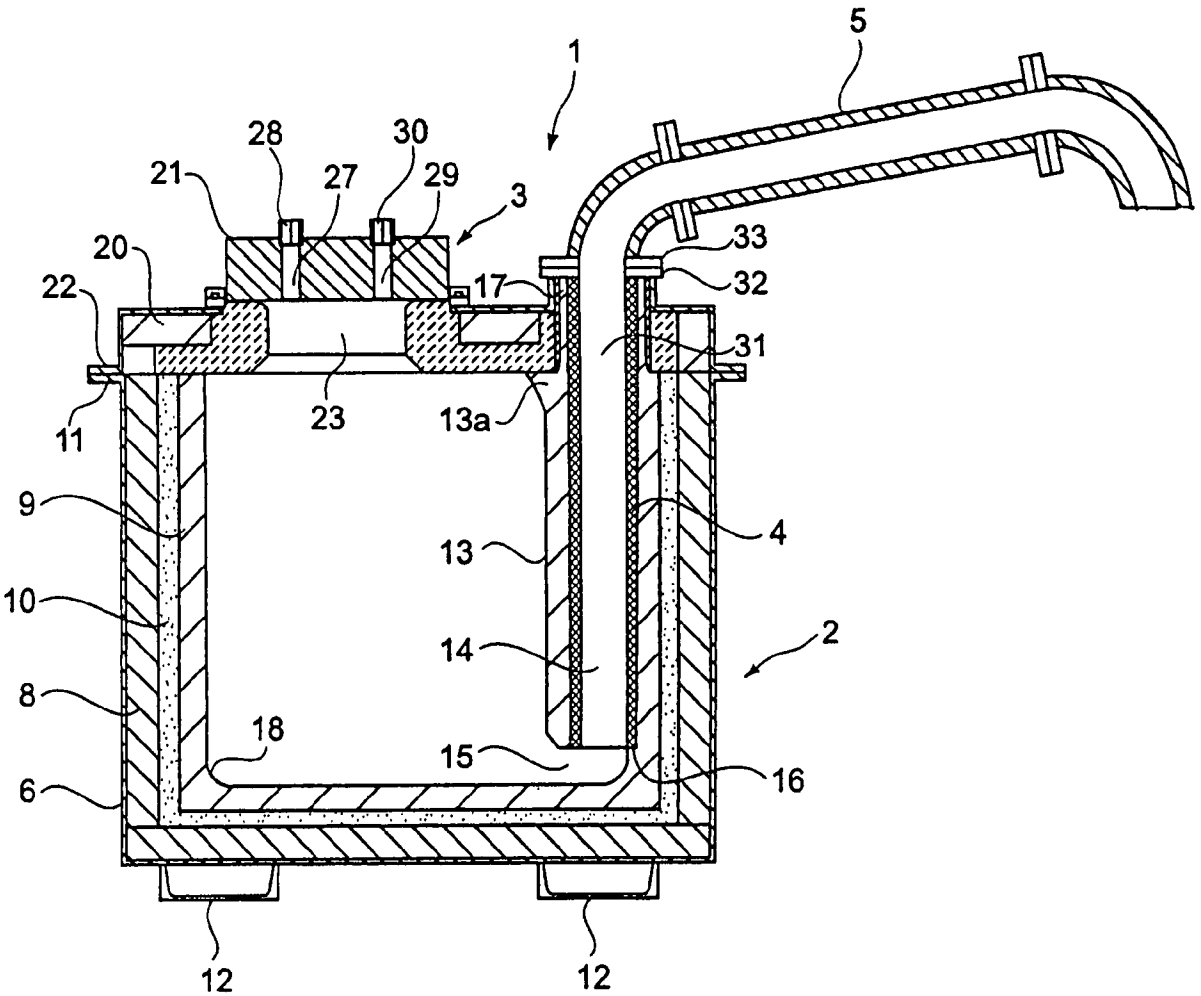
FIG. 2 is a sectional view showing the state of the container in FIG. 1 being assembled.
Figure 3:
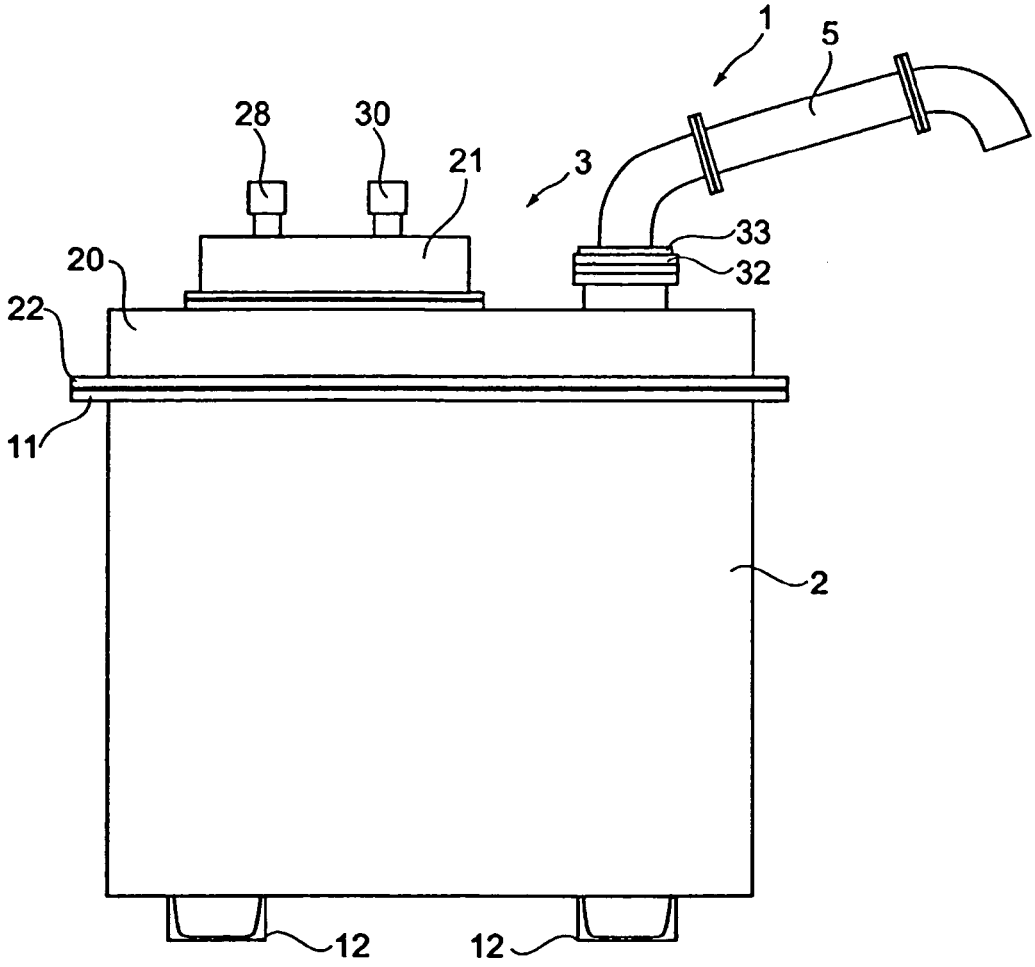
FIG. 3 is a plan view of FIG. 2.
Figure 4:
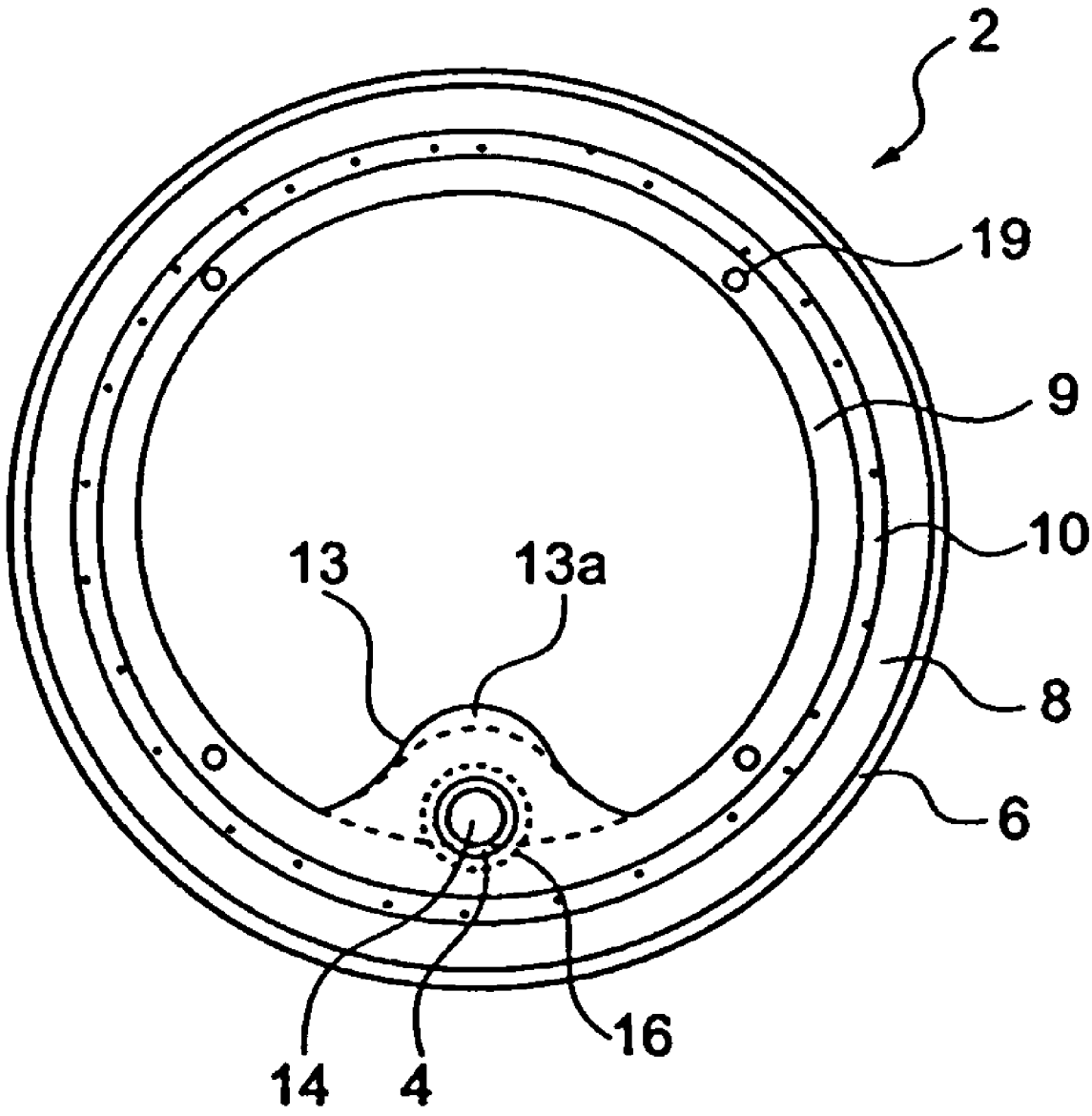
FIG. 4 is a plan view (without a lid) of FIG. 2.
Figure 5:
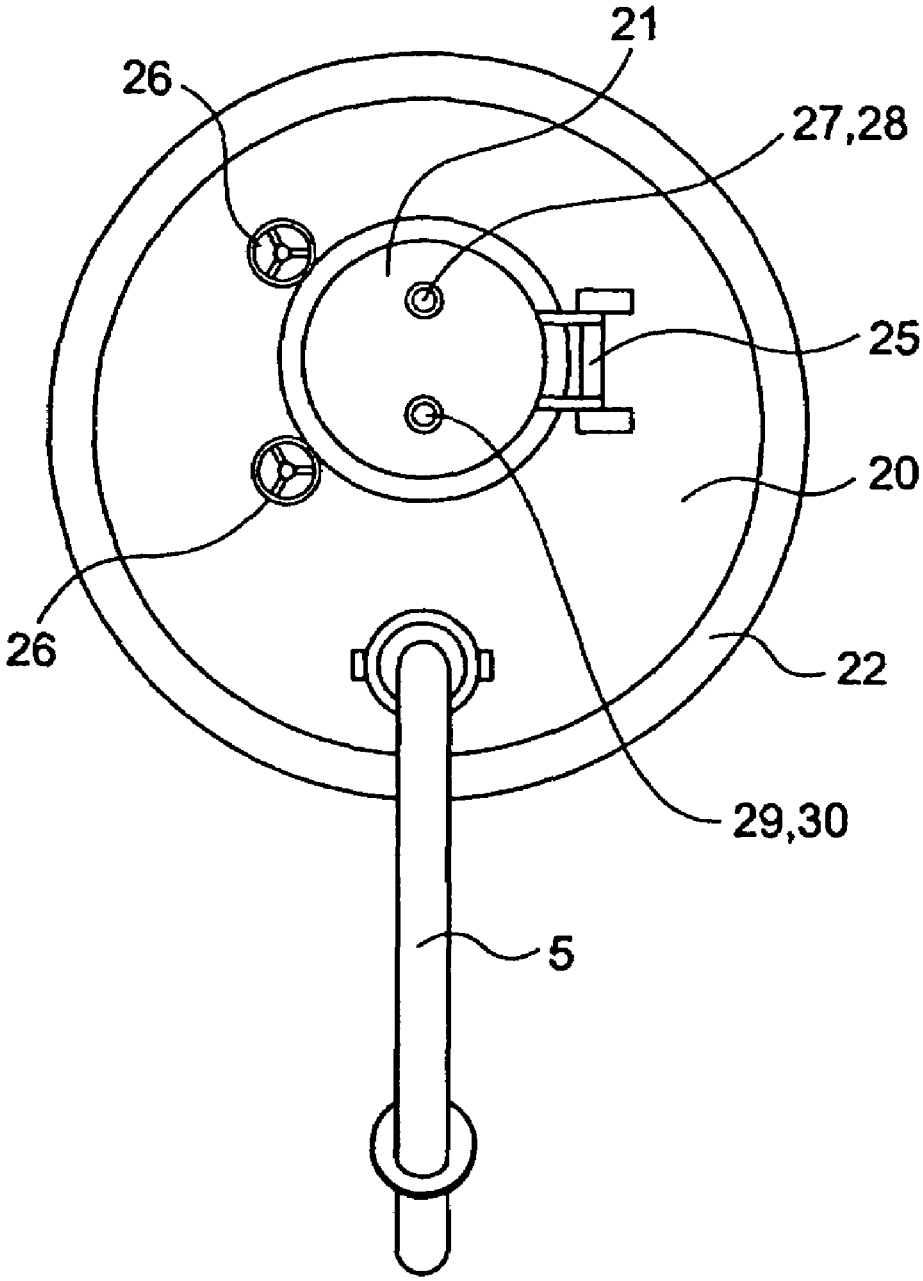
FIG. 5 is a plan view (with a lid) of FIG. 2.
Figure 6:
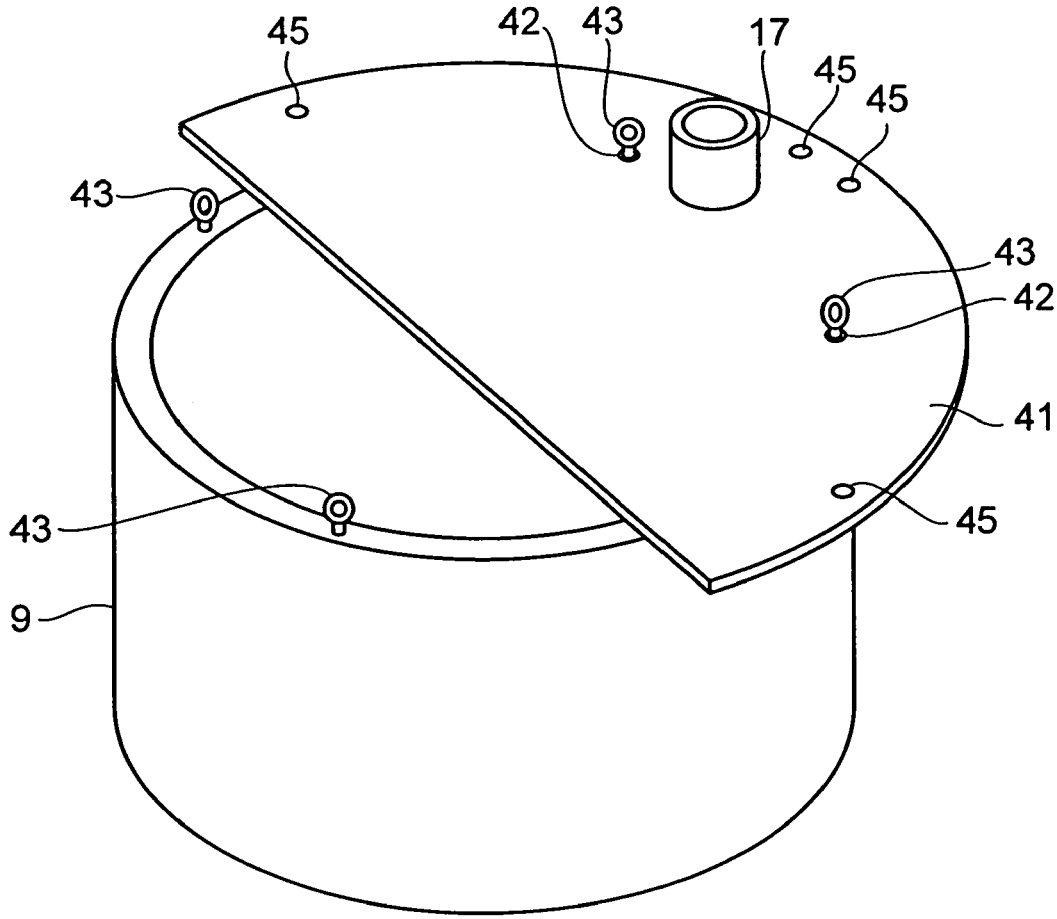
FIG. 6 is an explanatory diagram showing a method of producing the container (part 1).
Figure 7:
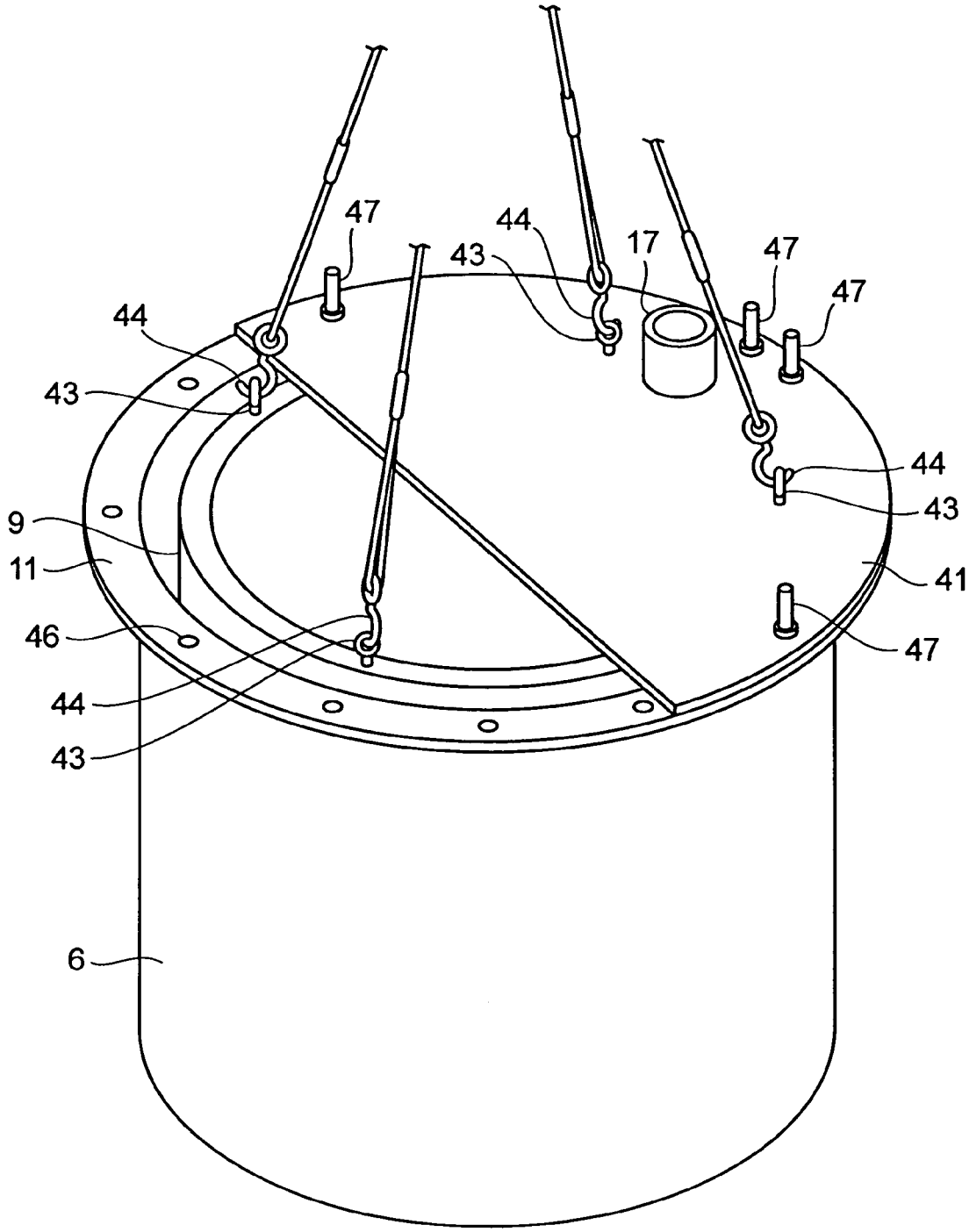
FIG. 7 is an explanatory diagram showing a method of producing the container (part 2).

1 Container
2 Container Body
3 Lid
4 First pipe
5 Second pipe
6 Frame
7 Inner wall
8 Insulating wall
9 Storing bath
10 Refractory and heat-insulating member
17 Protective layer
19 Hole for attaching anchor bolt

What is claimed is:

1. A container capable of being hermetically closed and storing a molten metal and supplying the molten metal to an outside using a pressure difference, comprising:

a frame body having an opening at an upper portion thereof;

a heat insulating wall laid onto an inner wall of the frame body;

a refractory storing bath, detachably inserted to an inner side of the heat insulating wall from the opening of the frame body to be integrally provided with the frame body;

a refractory and insu1ating member in a solid form containing a binder having a fusing point higher than that of the molten metal, inserted between the heat insulating wall and the refractory storing bath;

a lid that covers the opening of the frame body;

an introductory portion that introduces a gas for applying pressure into the storing bath covered with the lid; and a supplying portion that supplies the molten metal stored inside the storing bath to an outside, wherein the storing bath is formed so that a protruding portion extending to a vertical direction is formed on an inner side of the container and the flow path for the molten metal is provided inside the protruding portion, the flow path being made of ceramics, wherein the storing bath is comprised of a seamless rigid body of ceramics having at least two engaging members fixed to an upper surface, outer surface or an inner surface thereof enabling a connection with an outside, and wherein at least a part of the flow path is surrounded by a pipe made of ceramics.

2. The container as set for the in claim 1, wherein the refractory and insulating member is in a granule form.

3. The container as set forth in claim 1, wherein the refractory and insulating member is in a powder form.

4. The container as set forth in claim 1, wherein the storing bath has a flow path that consists a part of the supplying portion in the inside thereof.

5. The container as set forth in claim 4, wherein the supplying portion is comprised of the flow path and a pipe connected to the flow path.

6. A method of producing a container capable of being hermetically closed and storing a molten metal and supplying the molten metal to an outside using a pressure difference, comprising:

laying a heat insulating wall on an inner wall of the frame body having an opening at an upper portion thereof;

detachably inserting a refractory storing bath from the opening of the frame body to an inner side of the heat insulating wall;

inserting a refractory and insulating member in a solid form containing a binder having a fusing point higher than that of the molten metal between the heat insulating wall and the refractory storing bath and causing the refractory and insulating member to melt and solidify; and covering the opening of the frame body with a lid.

7. The method as set forth in claim 6, wherein the refractory and insulating member is in a granule form.

8. The method as set forth in claim 6, wherein the refractory and insulating member is in a powder form.

* * * * *